United States Patent [19]

Jansen

[11] 3,974,525

[45] Aug. 17, 1976

[54] METHOD OF KNITTING SOCKS HAVING A CLOSED TOE

[75] Inventor: Josephus Johannes Maria Jansen, Schijndel, Netherlands

[73] Assignee: Koninklijke Textielfabrieken, Schijndel, Netherlands

[22] Filed: Feb. 6, 1975

[21] Appl. No.: 547,457

[30] Foreign Application Priority Data

Feb. 19, 1974 Netherlands ..... 7402256

[52] U.S. Cl. ..... 2/61; 28/76 T; 66/172 R

[51] Int. Cl.[2] ..... D04D 9/56

[58] Field of Search ..... 66/172 R; 28/76 T

[56] References Cited

UNITED STATES PATENTS

| | | | |
|---|---|---|---|
| 2,437,735 | 3/1948 | Getaz | 66/172 R X |
| 2,729,957 | 1/1956 | Pope, Jr. | 66/172 R |
| 2,811,029 | 10/1957 | Conner | 66/172 R |
| 3,085,410 | 4/1963 | Loizillon | 66/172 R X |
| 3,270,526 | 9/1966 | Staciz et al. | 66/172 R |
| 3,327,500 | 6/1967 | Currier | 66/187 |
| 3,626,724 | 12/1971 | Wignall et al. | 66/172 X |

FOREIGN PATENTS OR APPLICATIONS

| | | | |
|---|---|---|---|
| 612,495 | 11/1948 | United Kingdom | 66/172 R |
| 937,375 | 9/1963 | United Kingdom | 66/172 R |

*Primary Examiner*—Henry S. Jaudon
*Attorney, Agent, or Firm*—Watson Leavenworth Kelton & Taggart

[57] ABSTRACT

In knitting socks in a string of such socks on a circular knitting machine, a double fabric is knitted in order to close the toe, further courses then being knitted with a heat-shrinking yarn, followed by knitting courses with a washable yarn, after which a start is made with knitting the welt of the next sock to be knitted. Thus by immersion of a string of such socks in a hot bath the washable yarn disappears to separate the socks and the shrinkable yarn shrinks to provide a run-free cast off.

2 Claims, 1 Drawing Figure

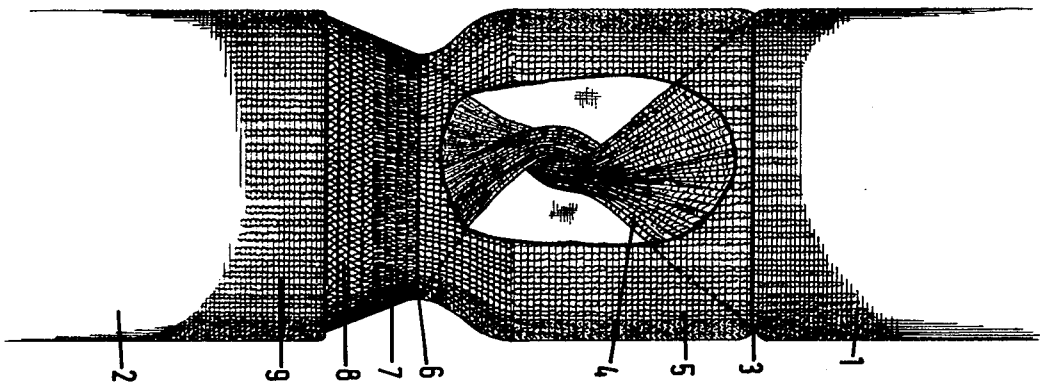
1
3
5
4
6
7
8
9
2

METHOD OF KNITTING SOCKS HAVING A CLOSED TOE

This invention relates to a method of knitting socks on a circular knitting machine. To close the toe a double fabric is knitted, while the last courses of the sock are knitted in spaced relation from the tip of the toe with a heat-shrinking yarn. In such a method it is known to blow hot air through the circular knitting machine directly after knitting of the last courses of the sock, thus causing the yarn with which the last courses have been knitted to shrink, so that a run-free casting off is obtained. After the sock has been knitted it is ejected or sucked away from the circular knitting machine, after which the next sock is knitted.

When knitting socks on a conventional circular knitting machine it is necessary that the socks leave the machine in interconnected fashion, because a knitted sock exerts a tensile force on the sock being knitted, which tensile force is essential during knitting.

After knitting a series of interconnected socks these socks can be severed, for example, by removing a colour-marked course or by cutting each sock adjacent the welt, whereupon the redundant piece of fabric connected to the toe portion is removed during looping or sewing up of the toe. This method does not have the casting off problem.

If on a circular knitting machine socks having a closed toe are knitted the casting off, which would be effected during looping or sewing up, is omitted. Besides the above method, in which hot air is blown through the circular knitting machine, other methods have been developed to make the last courses of each sock run-free. For example, the last courses of each sock can be knitted together with a synthetic rubber yarn or with an additional yarn and an extra firm stitch. As a result, a thickened rim forms at the casted off portion, spaced from the toe of the sock, which considerably reduces the quality of the sock.

In all methods known so far the socks leave the circular knitting machine in severed form, directly after knitting thereof. A disadvantage of this is that the circular knitting machine must have special retracting means which immediately after the starting course of a sock engage the finished fabric and keep it tensioned in order to ensure a proper knitting course. Though it is of course possible in the methods mentioned above to knit an intermediate portion after the last casting off courses, whereupon the welt of the next sock is started with, this is economically less attractive in actual practice, because removal of said intermediate portion cancels all advantages of knitting a sock having a closed toe.

The object of the present invention is to provide a method for knitting socks having a closed toe, and to avoid the above drawback, so that the sock can be knitted on a conventional circular knitting machine.

According to the present invention, after knitting the last courses of the sock with a heat-shrinking yarn according to the invention knitting is continued with a washable yarn, after a number of courses of which a start is made with knitting the welt of a next sock to be knitted, so that the socks leave the circular knitting machine in interconnected fashion whereupon by immersion in a hot bath both the washable yarn disappears and the shrinkable yarn makes the lastly knitted courses of the sock run-free. In this manner it is possible to knit socks having a closed toe on a conventional circular knitting machine which hitherto could only be manufactured with a specially constructed, new type of circular knitting machine. The known per se washable yarn can be removed by immersion of the series of socks in a water bath having a temperature higher than 60°C. Only when the washable yarn is removed from the series of socks, the last courses of each sock are protected from fraying owing to the presence of the fabric consisting of the washable yarn. As soon as the washable yarn is removed the protection from fraying is taken over by the lastly knitted courses of each sock, which courses are therefore knitted of a heat-shrinking yarn, said heating being present for removing the washable yarn.

One embodiment of knitting socks having a closed toe will be described for a better understanding of the invention, with reference to the drawing.

The drawing schematically shows the toe portion of a sock 1 and the welt portion of a different sock 2, as well as the connection therebetween, at the moment when the socks leave the circular knitting machine. When during the knitting of sock 1 the toe portion is reached, a double fabric is knitted. In the drawing this place is indicated by reference numeral 3. The two fabrics can be knitted both simultaneously, i.e. on the lower cylinder or the upper cylinder of the machine, but it is also possible to knit the two fabrics one after another, while the stitches of the last course of the other fabric, or the stitches to which the other fabric must be knitted are temporarily fixed. As shown in the drawing, the double fabric consists of an internal fabric 4 and an external fabric 5. After sufficient courses of the internal and the external fabric have been knitted, the edges of the two fabrics are rotated with respect to each other through a certain angle, after which the two edges are knitted together (indicated by reference numeral 6), followed by knitting a number of courses with a heat-shrinking yarn (reference numeral 7). The next step is knitting one or a number of courses with a washable yarn (reference numeral 8), after which a start is made with knitting the welt 9 of the next sock 2.

In order not to make the knot formed by twisting in the tip of the sock too thick, the last part of the double fabric can be knitted with a thinner yarn than the remaining fabric.

When a number of socks, connected as shown in the drawing, are immersed in a hot bath, the fabric 8 will disappear and also the fabric 7 will shrink. In the first place the socks are thereby severed and secondly the lastly knitted part of the toe of each sock is cast off run-free by shrinking the fabric 7.

Instead of closing the toe of the sock 1 by twisting the double fabric 4, 5, it is also possible to insert a yarn within the double fabric, so that the toe can be closed by tightening said yarn.

I claim:

1. In a method for knitting socks of a circular knitting machine in a connected string of such socks which includes, knitting a length of double fabric comprised of internal and external fabric parts to the toe portion of one sock, joining the edges of said internal and external fabrics together, continuing the knitting with a first series of courses of a heat shrinkable yarn and then a second series of courses of a washable yarn, and thereafter starting knitting of the welt of the next sock in the string, immersing the string in a heated bath of a liquid which is a solvent of said washable yarn, which concurrently causes said washable yarn to disappear severing the socks one from the other and the shrinkable yarn to shrink whereby the toe portion of each sock is cast off run-free.

2. A sock knitted according to the method of claim 1.

* * * * *

UNITED STATES PATENT OFFICE

CERTIFICATE OF CORRECTION

PATENT NO. : 3,974,525

DATED : August 17, 1976

INVENTOR(S) : Josephus Johannes Maria Jansen

It is certified that error appears in the above-identified patent and that said Letters Patent are hereby corrected as shown below:

Please change name of assignee to read --Koninklijke Textielfabrieken M. Jansen de Wit B.V.--.

Claim 1, Col. 2, line 51, "In a method for knitting socks of a circular knitting" should read --In a method for knitting socks on a circular knitting--.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*